US009415498B2

(12) United States Patent
Hecht et al.

(10) Patent No.: US 9,415,498 B2
(45) Date of Patent: Aug. 16, 2016

(54) HAMMER MECHANISM

(75) Inventors: Joachim Hecht, Magstadt (DE); Martin Kraus, Filderstadt (DE)

(73) Assignee: ROBERT BOSCH GMBH, Stuttgart (DE)

( * ) Notice: Subject to any disclaimer, the term of this patent is extended or adjusted under 35 U.S.C. 154(b) by 816 days.

(21) Appl. No.: 13/305,485

(22) Filed: Nov. 28, 2011

(65) Prior Publication Data

US 2012/0132451 A1 May 31, 2012

(30) Foreign Application Priority Data

Nov. 29, 2010 (DE) ..... 10 2010 062 099

(51) Int. Cl.
*B25D 16/00* (2006.01)
*B25D 11/06* (2006.01)

(52) U.S. Cl.
CPC ..... *B25D 16/006* (2013.01); *B25D 11/062* (2013.01); *B25D 2216/0023* (2013.01); *B25D 2216/0038* (2013.01); *B25D 2216/0069* (2013.01); *B25D 2217/0015* (2013.01); *B25D 2217/0023* (2013.01)

(58) Field of Classification Search
CPC ..... B25D 17/00; B25D 16/00; B25D 16/006; B25D 11/062; B25D 11/10; B25D 11/00; B25D 16/003; B25D 11/12; B25D 2216/0084; B25D 2216/0023; B25D 2216/061; B25D 2217/0015; B25D 17/06; B25D 2216/0036; B25D 2216/0069; B25B 21/02
USPC ..... 173/48, 112, 126, 128, 114, 13
See application file for complete search history.

(56) References Cited

U.S. PATENT DOCUMENTS

| | | | | | |
|---|---|---|---|---|---|
| 4,325,436 | A * | 4/1982 | Richter et al. | 173/13 | |
| 4,462,467 | A * | 7/1984 | Weingartner | B25D 16/00 173/105 | |
| 4,619,162 | A * | 10/1986 | Van Laere | 81/464 | |
| 5,052,497 | A * | 10/1991 | Houben et al. | 173/109 | |
| 5,337,835 | A * | 8/1994 | Bohne et al. | 173/13 | |
| 5,366,025 | A * | 11/1994 | Dutschk et al. | 173/109 | |
| 6,142,243 | A * | 11/2000 | Mayer | 173/176 | |
| 6,199,640 | B1 * | 3/2001 | Hecht | 173/48 | |
| 6,223,833 | B1 * | 5/2001 | Thurler et al. | 173/48 | |
| 6,550,546 | B2 * | 4/2003 | Thurler et al. | 173/48 | |
| 6,851,343 | B2 * | 2/2005 | Sasaki | 81/475 | |
| 6,892,827 | B2 * | 5/2005 | Toyama et al. | 173/48 | |
| 6,983,807 | B2 * | 1/2006 | Mayr et al. | 173/48 | |
| 6,983,810 | B2 * | 1/2006 | Hara et al. | 173/176 | |
| 6,988,562 | B2 * | 1/2006 | Hecht | 173/48 | |
| 7,059,425 | B2 * | 6/2006 | Ikuta | 173/128 | |
| 7,124,839 | B2 * | 10/2006 | Furuta et al. | 173/104 | |
| 7,168,503 | B1 * | 1/2007 | Teng | 173/48 | |

(Continued)

FOREIGN PATENT DOCUMENTS

| | | |
|---|---|---|
| GB | 2476560 | 6/2011 |
| WO | WO 2011/010497 | 1/2011 |

*Primary Examiner* — Michelle Lopez
*Assistant Examiner* — Eduardo R Ferrero
(74) *Attorney, Agent, or Firm* — Norton Rose Fulbright US LLP

(57) ABSTRACT

A hammer mechanism is described as having a snap die, a tool chuck drive shaft, and an impact generating shutoff unit, which has a blocking element, which is provided for the purpose of preventing an axial displacement of the snap die. The blocking element acts on the snap die in parallel to at least one force of the tool chuck drive shaft, at least during a drilling operation.

7 Claims, 8 Drawing Sheets

(56) References Cited

U.S. PATENT DOCUMENTS

| | | | | |
|---|---|---|---|---|
| 7,225,884 | B2 * | 6/2007 | Aeberhard | 173/93.5 |
| 7,314,097 | B2 * | 1/2008 | Jenner et al. | 173/48 |
| 7,350,592 | B2 * | 4/2008 | Hahn et al. | 173/48 |
| 7,380,612 | B2 * | 6/2008 | Furuta | 173/29 |
| 7,395,873 | B2 * | 7/2008 | Nakamura et al. | 173/93.5 |
| 7,455,121 | B2 * | 11/2008 | Saito et al. | 173/93.5 |
| 7,494,437 | B2 * | 2/2009 | Chen | 475/149 |
| 7,588,094 | B2 * | 9/2009 | Lin | 173/48 |
| 7,591,324 | B2 * | 9/2009 | Saur | 173/48 |
| 7,735,575 | B2 * | 6/2010 | Trautner | 173/114 |
| 2002/0084087 | A1 * | 7/2002 | Hecht et al. | 173/178 |
| 2003/0173178 | A1 * | 9/2003 | Sasaki | 192/3.51 |
| 2004/0026097 | A1 * | 2/2004 | Hecht | 173/114 |
| 2004/0194986 | A1 * | 10/2004 | Ikuta | 173/48 |
| 2004/0245005 | A1 * | 12/2004 | Toyama et al. | 173/48 |
| 2005/0061521 | A1 * | 3/2005 | Saito et al. | 173/48 |
| 2005/0199404 | A1 * | 9/2005 | Furuta et al. | 173/48 |
| 2005/0236168 | A1 * | 10/2005 | Lennartz | 173/109 |
| 2006/0118316 | A1 * | 6/2006 | Clark et al. | 173/128 |
| 2006/0144604 | A1 * | 7/2006 | Soika et al. | 173/162.2 |
| 2006/0201688 | A1 * | 9/2006 | Jenner et al. | 173/48 |
| 2007/0034398 | A1 * | 2/2007 | Murakami et al. | 173/210 |
| 2007/0039747 | A1 * | 2/2007 | Stirm | 173/109 |
| 2007/0102174 | A1 * | 5/2007 | Duesselberg et al. | 173/48 |
| 2007/0158086 | A1 * | 7/2007 | Puzio | 173/48 |
| 2007/0179328 | A1 * | 8/2007 | Murakami et al. | 585/448 |
| 2008/0041602 | A1 * | 2/2008 | Furuta | 173/48 |
| 2008/0169111 | A1 * | 7/2008 | Duesselberg et al. | 173/48 |
| 2008/0210448 | A1 * | 9/2008 | Ullrich et al. | 173/104 |
| 2009/0014195 | A1 * | 1/2009 | Lauterwald | 173/104 |
| 2009/0126955 | A1 * | 5/2009 | Trautner | 173/48 |
| 2009/0151966 | A1 * | 6/2009 | Chen | 173/48 |
| 2010/0193206 | A1 * | 8/2010 | Teng | 173/48 |
| 2010/0319945 | A1 * | 12/2010 | Chen | 173/48 |
| 2012/0132451 | A1 * | 5/2012 | Hecht et al. | 173/48 |
| 2014/0054056 | A1 * | 2/2014 | Moessnang et al. | 173/48 |
| 2014/0054057 | A1 * | 2/2014 | Ludy et al. | 173/48 |

* cited by examiner

HAMMER MECHANISM

RELATED APPLICATION INFORMATION

The present application claims priority to and the benefit of German patent application no. 10 2010 062 099.8, which was filed in Germany on Nov. 29, 2010, the disclosure of which is incorporated herein by reference.

FIELD OF THE INVENTION

The present invention is directed to a hammer mechanism.

BACKGROUND INFORMATION

A hammer mechanism having a snap die, a tool chuck drive shaft, and an impact generating shutoff unit, which has a blocking element, which is provided for the purpose of preventing an axial displacement of the snap die, has already been proposed.

SUMMARY OF THE INVENTION

The exemplary embodiments and/or exemplary methods of the present invention is directed to a hammer mechanism having a snap die, a tool chuck drive shaft, and an impact generating shutoff unit, which has a blocking element, which is provided for the purpose of preventing an axial displacement of the snap die.

The blocking element acts parallel to at least one force of the tool chuck drive shaft on the snap die, at least during a drilling operation. A "snap die" is to be understood in particular as an element of the hammer mechanism which transmits an impact momentum from a striker in the direction of an insertion tool during impact operation. The snap die may strike directly on the insertion tool in at least one operating state. The snap die may prevent penetration of dust through a tool chuck into the hammer mechanism. A "tool chuck drive shaft" is to be understood in particular as a shaft which transmits a rotational movement from a gear, in particular a planetary gear, in the direction of the tool chuck during rotary and/or percussion drilling operation. The tool chuck drive shaft is advantageously at least partially configured as a solid shaft. The tool chuck drive shaft may extend over at least 40 mm in the striking direction. The tool chuck drive shaft and the tool chuck may have an equal rotational speed during rotary and/or percussion drilling operation, in particular always, i.e., in particular a drivetrain between the tool chuck drive shaft and the tool chuck is free of a gear.

An "impact generating shutoff unit" is to be understood in particular as a unit which is provided for the purpose of allowing an operator to shut off the impact generating unit for a drilling and/or screwing operation. The impact generating shutoff unit may prevent automatic activation in particular of the impact generating unit when the insertion tool is pressed against a workpiece in a drilling and/or screwing mode. Contact pressure in a chisel and/or percussion drilling mode may cause an axial displacement of the tool chuck drive shaft.

The blocking element is advantageously provided for the purpose of preventing an axial displacement of the tool chuck drive shaft, the tool chuck, and/or advantageously the snap die in the drilling and/or screwing mode. "Provided" is to be understood in particular as specially configured and/or equipped. The term "parallel to a force" is to be understood in particular to mean that the tool chuck drive shaft and the blocking element cause a force on the snap die at two different positions in at least one operating state. Alternatively or additionally, the tool chuck drive shaft and the blocking element may exert a force on the tool chuck at two different positions in at least one operating state. The forces may have a component oriented in the same direction, which may be parallel to the rotational axis of the tool chuck drive shaft, from the tool chuck drive shaft in the direction toward the tool chuck. The blocking element may act directly on the snap die, however, which may particularly be at least via one tool chuck bearing. The tool chuck drive shaft may act directly on the snap die. The snap die may transmit a rotational movement from the tool chuck drive shaft to the tool chuck. Through the embodiment according to the present invention, an advantageous arrangement of an operating element of the impact generating shutoff unit may be achieved with a simple configuration. In particular, a ring-shaped operating element, which encloses the snap die or the tool chuck drive shaft, is easily implementable. In addition, little installation space is required with this configuration.

In another embodiment, it is proposed that the impact generating shutoff unit have a sliding guide, which is provided for the purpose of moving the blocking element, whereby low production costs and a high level of robustness may be achieved. A "sliding guide" is to be understood in particular as a device in which a bevel of an element presses the blocking element from one position into another position in the event of a movement of the element. A "bevel" is to be understood in particular as an inclined face of the element in relation to a direction of the movement. The sliding guide may have a face which axially fixes the tool chuck via the blocking element in at least one operating state.

Furthermore, it is proposed that the impact generating shutoff unit have a rotatably mounted operating element, whereby a particularly ergonomic operation is possible. A "rotatably mounted operating element" is to be understood in particular as an element, using which the hammer mechanism may be switched from one operating mode into another operating mode by a rotational movement of the operating element. The operating element may enclose a rotational axis of the tool chuck drive shaft. The operating element may be rotatable around an axis which is oriented parallel to the tool chuck drive shaft.

Furthermore, it is proposed that the hammer mechanism have a housing element, which is provided for the purpose of mounting the blocking element in a rotationally fixed manner, whereby a configuration having a particularly simple configuration is possible. The term "mount in a rotationally fixed manner" is to be understood in particular to mean that the blocking element is mounted so it is translationally movable.

In an advantageous embodiment of the present invention, it is proposed that the hammer mechanism have a striker, which mounts the tool chuck drive shaft so it is movable in the striking direction in at least one operating state, whereby a low weight and a small overall size are possible. In particular, the term "striker" is to be understood as an arrangement of the hammer mechanism, which is provided for the purpose of being translationally accelerated in particular during operation by the impact generating unit and delivering a momentum absorbed during the acceleration as an impact momentum in the direction of the insertion tool. The striker may be mounted so it may be accelerated in the striking direction by an air pressure or advantageously by a rocker. The striker may be unaccelerated immediately before an impact. The striker may deliver an impact momentum in the direction of the insertion tool, in particular via a snap die, to the insertion tool in the case of an impact. A "rocker" is to be understood in particular as an arrangement which is mounted movably around a pivot axis and which is provided for the purpose of delivering power absorbed on a first coupling area to a second coupling area. A "striking direction" is to be understood in particular as a direction which runs parallel to a rotational axis of the tool chuck and is oriented from the striker in the direction toward the tool chuck. The striking direction may be oriented parallel to a rotational axis of the tool chuck drive shaft. The term "mounted so it is movable" is to be understood in particular to mean that the tool chuck drive shaft has a bearing surface, which transmits bearing forces perpendicularly to the striking direction onto the striker in at least one operating state.

Furthermore, it is proposed that the tool chuck drive shaft at least partially penetrate the striker, whereby a tool chuck drive shaft may be provided having a particularly small mass and a small installation space requirement. In particular, the term "at least partially penetrate" is to be understood to mean that the striker encloses the tool chuck drive shaft by more than 270°, advantageously by 360°, on at least one plane, which is advantageously oriented perpendicularly to the striking direction. The striker may be fastened in a form-locked manner on the tool chuck drive shaft in a direction perpendicular to the rotational axis of the tool chuck drive shaft, i.e., mounted so it is movable in the direction of the rotational axis.

In addition, it is proposed that the hammer mechanism include at least one bearing, which is provided for the purpose of mounting the tool chuck drive shaft so it is axially displaceable, whereby an impact mechanism shutoff having a simple configuration is possible. A "bearing" is to be understood in particular as a device which fastens the tool chuck drive shaft in particular so it is movable at least around the rotational axis and axially displaceable in relation to a housing. "Axially displaceable" is to be understood in particular to mean that the bearing fastens the tool chuck drive shaft so it is movable parallel to the striking direction, in particular in relation to a housing. A connection of the coupling arrangement of the tool chuck drive shaft, which drives the impact generating unit, may be disengaged by an axial displacement of the tool chuck drive shaft.

Furthermore, it is proposed that the hammer mechanism have a planetary gear, which drives the tool chuck drive shaft in at least one operating state, whereby an advantageous transmission ratio may be achieved in a small space. Furthermore, torque limiting and multiple gear stages may be implemented with a simple configuration. A "planetary gear" is to be understood in particular as a unit having at least one planet wheel set. A planet wheel set may have a sun wheel, an annulus gear, a planet wheel carrier, and at least one planet wheel guided by the planet wheel carrier on an orbit around the sun wheel. The planetary gear may have at least two transmission ratios, which are selectable by an operator, between an input and an output of the planetary gear.

Furthermore, it is proposed that the snap die have a coupling arrangement, which is provided for transmitting a rotational movement to a tool chuck, whereby a particularly compact hammer mechanism may be provided. The snap die advantageously transmits a rotational movement of the tool chuck drive shaft to the tool chuck. The term "tool chuck" is to be understood in particular as a device which is provided for the purpose of directly fastening an insertion tool so it may be disengaged by an operator in particular without tools, and at least in a rotationally fixed manner.

Furthermore, it is proposed that the hammer mechanism include an impact generating unit and a coupling arrangement, which is connected in a rotationally fixed manner to the tool chuck drive shaft and which is provided for the purpose of driving the impact generating unit, whereby a particularly compact and high-performance hammer mechanism may be provided with a simple configuration. An "impact generating unit" is to be understood in particular as a unit which is provided for the purpose of converting a rotational movement into an impact movement of the striker, in particular a translational movement, which is suitable for rotary and percussion drilling operation. In particular, the impact generating unit is configured as an impact generating unit which appears meaningful to a person skilled in the art, but which may be configured as a pneumatic impact generating unit and/or which may particularly be configured as an impact generating unit having the rocker.

A "coupling arrangement" is to be understood in particular as a arrangement which is provided for the purpose of transmitting a movement from one component to another component at least by a form lock. The form lock may be configured in such a way that it may be disengaged by the operator in at least one operating state. The form lock may particularly be disengaged to switch over an operating mode, advantageously between screwing operation, drilling operation, chisel operation, and/or percussion drilling operation. In particular, the coupling arrangement is configured as a coupling which appears meaningful to a person skilled in the art, but advantageously as a claw coupling and/or a gearing. The coupling arrangement advantageously has multiple form-locked elements and an area which connects the form-locked elements. In particular, the term "rotationally fixed" is to be understood to mean that the coupling arrangement and the tool chuck drive shaft are fixedly connected to one another at least in the peripheral direction, which may be in every direction, and in particular in every operating state. In particular, "driving" is to be understood in this context to mean that the coupling arrangement transmits a kinetic energy, in particular a rotational energy, to at least one area of the impact generating unit. The impact generating unit may drive the striker using this energy. Through the embodiment according to the present invention, a particularly compact and high-performance hammer mechanism may be provided, having a simple configuration.

In addition, the hammer mechanism has a spur gear stage, which converts a rotational speed of the tool chuck drive shaft into a higher rotational speed for impact generation, whereby a particularly advantageous ratio between rotational speed and impact count of an insertion tool may be achieved with a simple configuration and in a space-saving way. A "spur gear stage" is to be understood in particular as an arrangement of two meshing gearwheels in particular, which are mounted rotatably around parallel axes. The gearwheels may have a gearing on a surface facing away from their axis. In particular, a "rotational speed for impact generation" is to be understood as a rotational speed of a drive arrangement, which appears meaningful to a person skilled in the art, of the impact generating unit, which converts a rotational movement into a linear movement. The drive arrangement of the impact generating unit may be configured as a wobble bearing or particularly may be configured as an eccentric element. "Converting" is to be understood here to mean that the rotational speed of the tool chuck drive shaft and the rotational speed for impact generation differ. The rotational speed for impact generation may be greater, advantageously at least twice as great as the rotational speed of the tool chuck drive shaft. A transmission ratio of the rotational speed for impact generation to the rotational speed of the tool chuck drive shaft particularly may be a non-integer number.

Furthermore, the hammer mechanism includes a torque limiting device, which is provided for the purpose of limiting a maximum torque which may be transmitted via the tool chuck drive shaft, whereby the operator is advantageously protected and the handheld tool may be used comfortably and efficiently for screwing. "Limiting" is to be understood in particular in this context to mean that the torque limiting device prevents the maximum torque, which is settable in particular by an operator, from being exceeded. The torque limiting device may open a connection between a drive motor and the tool chuck, which is rotationally fixed during operation. Alternatively or additionally, the torque limiting device may act on a power supply of the drive motor.

Furthermore, a handheld tool having a hammer mechanism according to the present invention is described. A "handheld tool" is to be understood in this context in particular as a handheld tool which appears meaningful to a person skilled in the art, but which may be a drill, a rotary hammer drill, an electric screwdriver, a drill chisel, and/or a percussion hammer. The handheld tool may be configured as a battery-powered handheld tool, i.e., in particular the handheld tool has a coupling arrangement, which is provided for the purpose of supplying a drive motor of the handheld tool with electrical power from a handheld tool battery connected to the coupling arrangement.

Further advantages result from the following description of the drawings. Five exemplary embodiments of the present invention are shown in the drawings. The drawings, the description, and the claims contain numerous features in combination. A person skilled in the art will advantageously also consider the features individually and combine them into meaningful further combinations.

DETAILED DESCRIPTION

Figure 1:
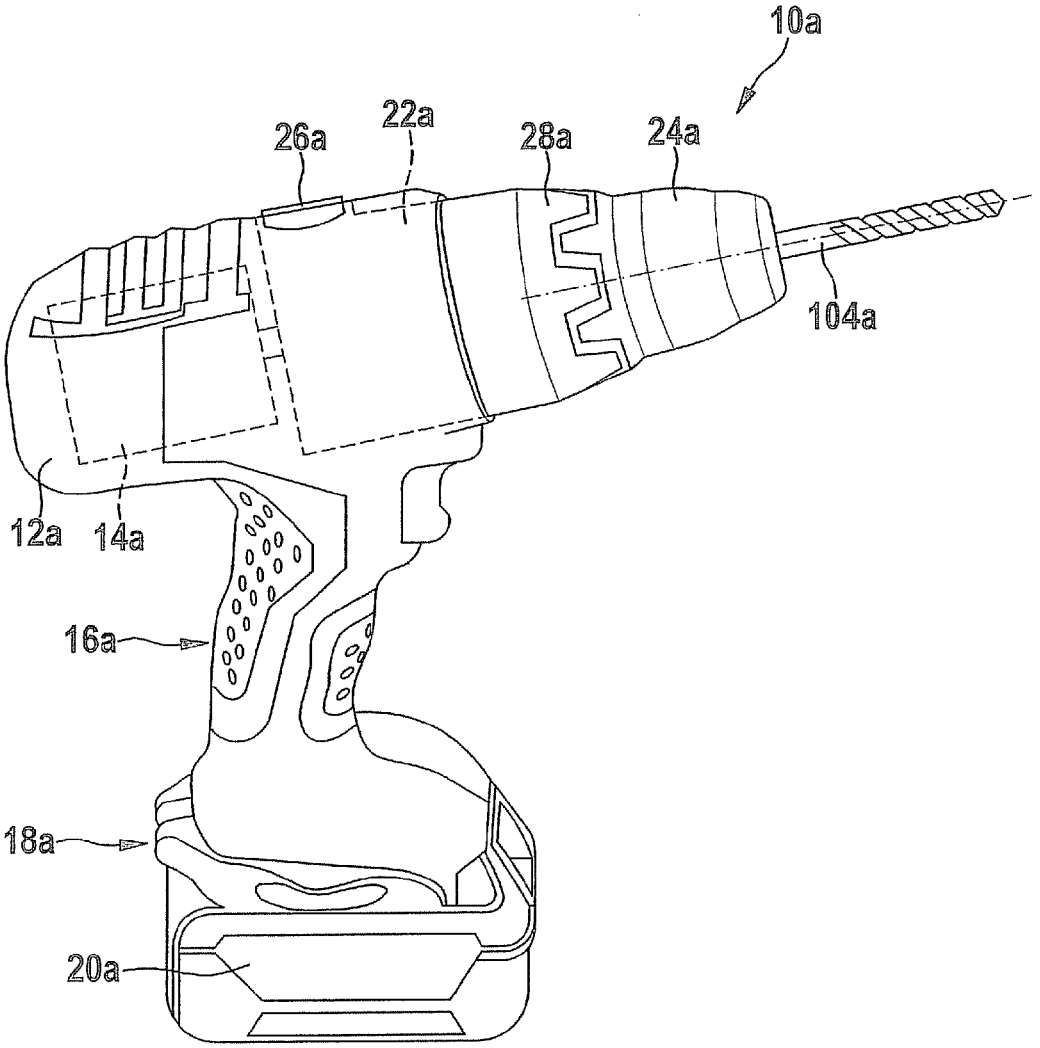
FIG. 1 shows a handheld tool having a hammer mechanism according to the present invention in a perspective view.

FIG. 1 shows a handheld tool 10*a*, which is configured as a rotary hammer drill. Handheld tool 10*a* has a pistol-shaped housing 12*a*. A drive motor 14*a* of handheld tool 10*a* is situated in housing 12*a*. Housing 12*a* has a handle area 16*a* and a battery coupling arrangement 18*a*, which is situated on an end of handle area 16*a* facing away from drive motor 14*a*. Battery coupling arrangement 18*a* couples a handheld tool battery 20*a* in a way which may be electrically and mechanically disconnected by an operator. Handheld tool battery 20*a* has an operating voltage of 10.8 V, but may also have a different, in particular a higher, operating voltage. Furthermore, handheld tool 10*a* has a hammer mechanism 22*a* according to the present invention, having an externally situated tool chuck 24*a* and operating elements 26*a*, 28*a*.

Figure 2:
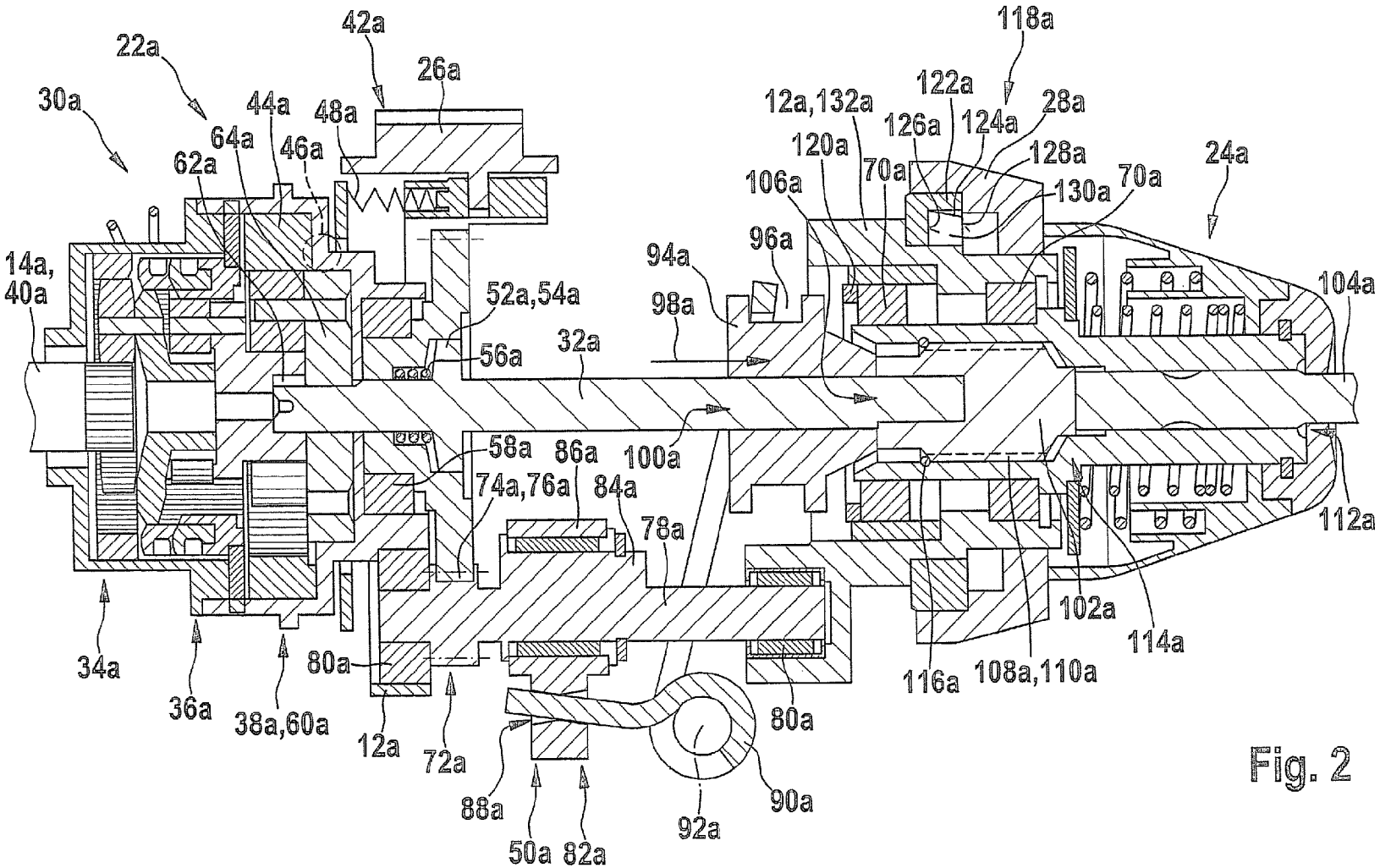
FIG. 2 shows a section of the hammer mechanism from FIG. 1.

FIG. 2 shows hammer mechanism 22*a* in a sectional view. Furthermore, hammer mechanism 22*a* includes a planetary gear 30*a* and a tool chuck drive shaft 32*a*. Planetary gear 30*a* drives tool chuck drive shaft 32*a* to rotate around an rotational axis during operation. For this purpose, planetary gear 30*a* has three planetary gear stages 34*a*, 36*a*, 38*a*. A transmission ratio of planetary gear 30*a* between a rotor 40*a* of drive motor 14*a* and tool chuck drive shaft 32*a* is settable by an operator in at least two stages. Alternatively, a transmission ratio between drive motor 14*a* and tool chuck drive shaft 32*a* may be nonadjustable.

Hammer mechanism 22*a* has a torque limiting device 42*a*. Torque limiting device 42*a* holds an annulus gear 44*a* of planetary gear 30*a* fixed during operation. For this purpose, torque limiting device 42*a* has fixation balls 46*a*, which engage in recesses of annulus gear 44*a*. A spring 48*a* of torque limiting device 42*a* exerts a force on fixation balls 46*a* in the direction of annulus gear 44*a* for this purpose. An end of spring 48*a* facing toward fixation balls 46*a* is movable in the direction of fixation balls 46*a* by an operator with the aid of one of operating elements 26*a*. For this purpose, operating element 26*a* has an eccentric element. The force acting on fixation balls 46*a* is therefore settable. When a certain maximum torque is reached, fixation balls 46*a* are pressed out of the recesses and annulus gear 44*a* runs free, whereby a force transmission between rotor 40*a* and tool chuck drive shaft 32*a* is interrupted. Torque limiting device 42*a* is therefore provided for the purpose of limiting a maximum torque transmittable via tool chuck drive shaft 32*a*.

Figure 3:
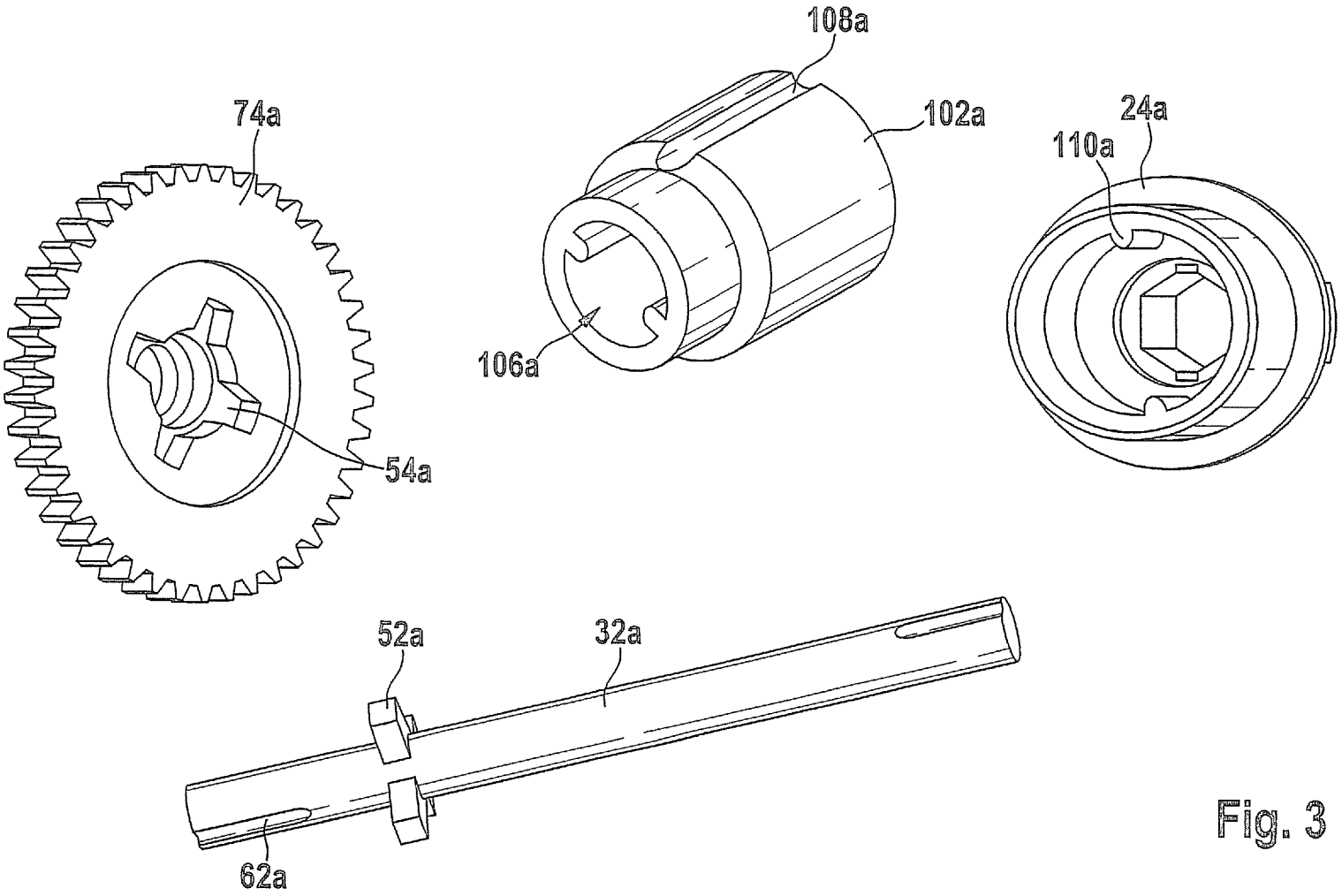
FIG. 3 shows a coupling arrangement, a tool chuck drive shaft, a snap die, and a part of a tool chuck of the hammer mechanism from FIG. 1, each shown individually in a perspective view.

Hammer mechanism 22*a* has an impact generating unit 50*a* and a first coupling arrangement 52*a*. First coupling arrangement 52*a* is connected in a rotationally fixed manner to tool chuck drive shaft 32*a*; in fact, first coupling arrangement 52*a* and tool chuck drive shaft 32*a* are formed in one piece. Impact generating unit 50*a* has a second coupling arrangement 54*a*, which is connected in a rotationally fixed manner to first coupling arrangement 52*a* in a rotary and/or percussion drilling mode. As also shown in FIG. 3, first coupling arrangement 52*a* is configured as molds and second coupling arrangement 54*a* is configured as recesses. In the event of an activation of the drilling mode, first coupling arrangement 52*a* plunges completely into second coupling arrangement 54*a*. The coupling between first coupling arrangement 52*a* and second coupling arrangement 54*a* may therefore be disengaged by an axial displacement of tool chuck drive shaft 32*a* in the direction of tool chuck 24*a*. A spring 56*a* of hammer mechanism 22*a* is situated between first coupling arrangement 52*a* and second coupling arrangement 54*a*. Spring 56*a* presses tool chuck drive shaft 32*a* in the direction of tool chuck 24*a*. The spring opens the coupling between first coupling arrangement 52*a* and second coupling arrangement 54*a* when impact generating unit 50*a* is shut off.

Hammer mechanism 22*a* has a first bearing 58*a*, which fixes second coupling arrangement 54*a* in relation to housing 12*a* in the axial direction and mounts it so it is rotatable coaxially to tool chuck drive shaft 32*a*. Furthermore, hammer mechanism 22*a* has a second bearing 60*a*, which mounts tool chuck drive shaft 32*a* so it is rotatable around the rotational axis on a side facing toward drive motor 14*a*. Second bearing 60*a* is formed in one piece with one of three planetary gear stages 38*a*. Tool chuck drive shaft 32*a* has a coupling arrangement 62*a*, which connects it in an axially displaceable and rotationally fixed manner to a planet wheel carrier 64*a* of this planetary gear stage 38*a*. This planetary gear stage 38*a* is therefore provided for the purpose of mounting tool chuck drive shaft 32*a* so it is axially displaceable. On a side facing toward tool chuck 24*a*, tool chuck drive shaft 32*a* is mounted by a tool chuck bearing 70*a* so it is rotatable together with tool chuck 24*a*. Tool chuck bearing 70*a* has a rear bearing element, which is pressed in an axially fixed manner on tool chuck 24*a*. Furthermore, tool chuck bearing 70*a* has a front bearing element, which mounts tool chuck 24*a* so it is axially displaceable in housing 12*a*.

Impact generating unit 50*a* includes a spur gear stage 72*a*, which converts a rotational speed of tool chuck drive shaft 32*a* into a higher rotational speed for impact generation. A first gearwheel 74*a* of spur gear stage 72*a* is formed in one piece with second coupling arrangement 54*a*. During a percussion drilling operation, it is driven by tool chuck drive shaft 32*a*. A second gearwheel 76*a* of spur gear stage 72*a* is formed in one piece with an impact mechanism shaft 78*a*. A rotational axis of impact mechanism shaft 78*a* is situated adjacent in the radial direction to the rotational axis of tool chuck drive shaft 32*a*. Impact generating unit 50*a* has two bearings 80*a*, which mount the impact mechanism shaft 78*a* so it is rotatable and axially fixed. Impact generating unit 50*a* has a drive arrangement 82*a*, which converts a rotational movement of impact mechanism shaft 78*a* into a linear movement. An eccentric element 84*a* of drive arrangement 82*a* is formed in one piece with impact mechanism shaft 78*a*. An eccentric sleeve 86*a* of drive arrangement 82*a* is rotatably mounted on eccentric element 84*a* in relation to eccentric element 84*a*, with the aid of a needle bearing. Eccentric sleeve 86*a* has a recess 88*a*, which encloses a rocker 90*a* of impact generating unit 50*a*.

Rocker 90*a* is mounted so it is pivotable on a tilt axis 92*a* of impact generating unit 50*a*, specifically pivotable around an axis which is oriented perpendicularly to the rotational axis of tool chuck drive shaft 32*a*. An end of rocker 90*a* facing away from drive arrangement 82*a* partially encloses a striker 94*a* of hammer mechanism 22*a*. The rocker engages in a recess 96*a* of striker 94*a*. Recess 96*a* is configured in a ring shape. During a percussion drilling operation, rocker 90*a* causes a force on striker 94*a* which accelerates it. Rocker 90*a* is moved sinusoidally during operation. Rocker 90*a* has a resilient configuration. It has a spring constant between eccentric sleeve 86*a* and striker 94*a* of less than 100 N/mm and greater than 10 N/mm. In this exemplary embodiment, rocker 90*a* has a spring constant of approximately 30 N/mm.

Tool chuck drive shaft 32*a* mounts striker 94*a* movably in striking direction 98*a*. For this purpose, striker 94*a* delimits a recess 100*a*. Tool chuck drive shaft 32*a* penetrates striker 94*a* through recess 100*a*. Striker 94*a* encloses recess 100*a* over 360° in a plane perpendicular to recess 100*a*. During operation, striker 94*a* strikes a snap die 102*a* of hammer mechanism 22*a*. Snap die 102*a* is situated between an insertion tool 104*a* and striker 94*a*. In an operationally ready state, insertion tool 104*a* is fastened in tool chuck 24*a*. Tool chuck 24*a* mounts snap die 102*a* so it is movable parallel to striking direction 98*a*. Snap die 102*a* relays impact momentum, which comes from striker 94*a* during a percussion drilling operation, to insertion tool 104*a*.

Tool chuck drive shaft 32*a* is connected to snap die 102*a* so it is axially movable and rotationally fixed. For this purpose, snap die 102*a* delimits a recess 106*a*. In an operationally ready state, tool chuck drive shaft 32*a* is partially situated in recess 106*a* of snap die 102*a*. Tool chuck drive shaft 32*a* is mounted rotatably via snap die 102*a*, tool chuck 24*a*, and tool chuck bearing 70*a*. Tool chuck 24*a* is driven to rotate via snap die 102*a*. For this purpose, tool chuck 24*a* and snap die 102*a* each have a coupling arrangement 108*a*, 110*a*, the coupling arrangement being provided for transmitting the rotational movement to tool chuck 24*a*. Coupling arrangement 108*a* of snap die 102*a* is configured as a groove, whose main extension is situated parallel to striking direction 98*a*. Coupling arrangement 108*a* extends along a radial external lateral surface of snap die 102*a*. Coupling arrangement 110*a* of tool chuck 24*a* is configured as a protrusion which matches the groove.

Tool chuck 24*a* has an insertion tool coupling area 112*a*, in which insertion tool 104*a* is fastened so it is fixed in striking direction 98*a* during a drilling or screwing operation, or in which it is fastened so it is movable in striking direction 98*a* during a percussion drilling operation. In addition, the tool chuck has a taper 114*a*, which delimits a movement range of snap die 102*a* in striking direction 98*a*. Furthermore, tool chuck 24*a* has a fastening ring 116*a*, which delimits a movement range of snap die 102*a* against striking direction 98*a*.

During a percussion drilling procedure, an operator presses insertion tool 104*a* against a workpiece (not shown). The operator thus displaces insertion tool 104*a*, snap die 102*a*, and tool chuck drive shaft 32*a* in relation to housing 12*a* in a direction against striking direction 98*a*, i.e., in the direction of drive motor 14*a*. The operator compresses spring 56*a* of hammer mechanism 22*a*. First coupling arrangement 52*a* plunges into second coupling arrangement 54*a*, whereby tool chuck drive shaft 32*a* begins to drive impact generating unit 50*a*. When the operator stops pressing insertion tool 104*a* against the workpiece, spring 56*a* displaces tool chuck drive shaft 32*a*, snap die 102*a*, and insertion tool 104*a* in striking direction 98*a*. A rotationally fixed connection between first coupling arrangement 52*a* and second coupling arrangement 54*a* is thus opened, whereby impact generating unit 50*a* is shut off.

Hammer mechanism 22*a* has an impact generating shutoff unit 118*a* having a blocking element 120*a*, a sliding guide 122*a*, and an operating element 28*a*. In a drilling or screwing mode, blocking element 120*a* causes a force on snap die 102*a* which acts on snap die 102*a* in parallel to at least one force of tool chuck drive shaft 32*a*. The force of blocking element 120*a* acts on snap die 102*a* via tool chuck bearing 70*a*, tool chuck 24*a*, and fastening ring 116*a*. Due to the force of blocking element 120*a*, in a drilling or screwing mode, an axial displacement of snap die 102*a* and tool chuck drive shaft 32*a* and therefore an activation of impact generating unit 50*a* are prevented. The force of tool chuck drive shaft 32*a* has a component which is parallel in action, which drives snap die 102*a* to rotate during operation. In addition, the force has a component which is parallel in action and direction, which is caused by spring 56*a* via tool chuck drive shaft 32*a* on snap die 102*a*.

Figure 4:
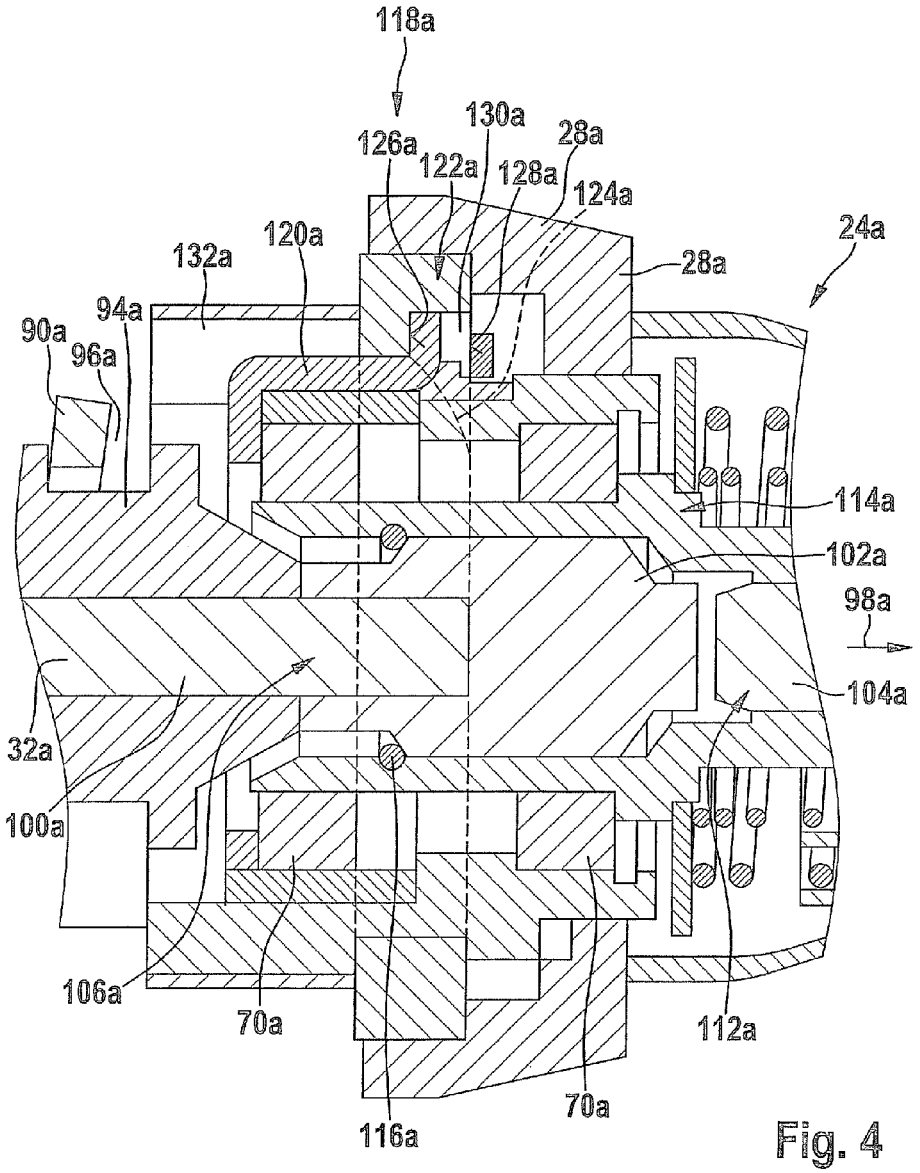
FIG. 4 shows another partial section of the hammer mechanism from FIG. 1, which shows an impact generating shutoff unit of the hammer mechanism.

FIG. 4 shows a section oriented perpendicularly to the section of FIG. 2 and parallel to striking direction 98*a*, operating element 28*a* being situated in two different positions in the sections of FIGS. 2 and 4. Operating element 28*a* is configured in a ring shape. It coaxially encloses the rotational axis of tool chuck drive shaft 32*a*. Operating element 28*a* is rotatably mounted. It is connected in a rotationally fixed manner to sliding guide 122*a*. Sliding guide 122*a* is also configured as ring-shaped. Sliding guide 122*a* has a bevel 124*a*. Bevel 124*a* connects two faces 126*a*, 128*a* of sliding guide 122*a*. Faces 126*a*, 128*a* are oriented perpendicularly to striking direction 98*a*. Faces 126*a*, 128*a* are situated on different planes in striking direction 98*a*.

In a percussion drilling mode, blocking element 120*a* is situated in a recess 130*a*, which is delimited, inter alia, by bevel 124*a* and one of faces 126*a*. This face 126*a* is situated closer to drive motor 14*a* than the other face 128*a*. Housing 12*a* has a housing element 132*a*, which mounts the blocking element so it is rotationally fixed and displaceable in striking direction 98*a*. At the beginning of a percussion drilling procedure, blocking element 120*a* may thus be pressed together with tool chuck 24*a* in a direction against striking direction 98*a*. During a percussion drilling procedure, blocking element 120*a* does not cause any blocking force on tool chuck 24*a*. During a rotation of operating element 28*a* of impact generating shutoff unit 118*a*, blocking element 120*a* is moved by bevel 124*a* in striking direction 98*a*. Blocking element 120*a* is held in this forward position in the drilling or screwing mode. Blocking element 120*a* thus prevents an axial displacement of tool chuck drive shaft 32*a* in the drilling or screwing mode.

Further exemplary embodiments of the present invention are shown in FIGS. 5 through 11. The following descriptions and the drawings are essentially restricted to the differences between the exemplary embodiments, reference fundamentally being able to be made to the drawings and/or the description of the other exemplary embodiments, in particular of FIGS. 1 through 4, with respect to identically identified components, in particular with respect to components having identical reference numerals. To differentiate the exemplary embodiments, the letter a follows the reference numerals of the exemplary embodiment in FIGS. 1 through 4. In the exemplary embodiments of FIGS. 5 through 11, the letter a is replaced by the letters b through e.

Figure 5:
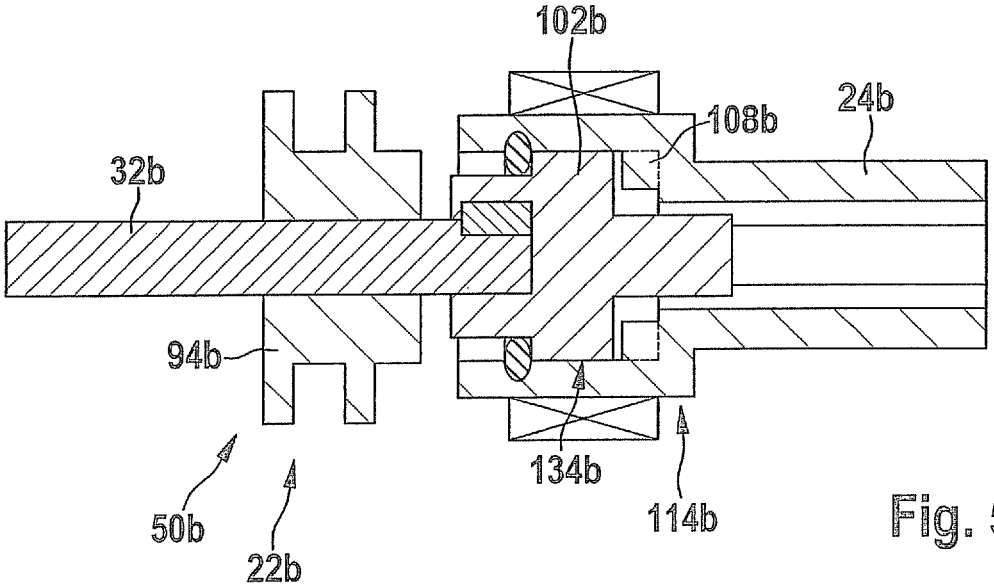
FIG. 5 shows a first alternative exemplary embodiment of a snap die of the hammer mechanism from FIG. 1 in a schematic view.

FIG. 5 shows a part of a hammer mechanism 22*b*. A striker 94*b* of an impact generating unit 50*b* of hammer mechanism 22*b* is mounted so it is movable on a tool chuck drive shaft 32*b* of hammer mechanism 22*b*. Tool chuck drive shaft 32*b* is connected to a snap die 102*b* of hammer mechanism 22*b* so it is axially displaceable and rotationally fixed. Snap die 102*b* has a coupling arrangement 108*b*, which forms a rotationally fixed connection to a tool chuck 24*b* of hammer mechanism 22*b* in at least one operating state. Coupling arrangement 108*b* is situated on a side which faces toward a taper 114*b* of tool chuck 24*b*. Coupling arrangement 108*b* is configured as a gearing. A sealing area 134*b* of the snap die presses without a gearing against tool chuck 24*b* and advantageously prevents penetration of dust into impact generating unit 50*b*.

Figure 6:
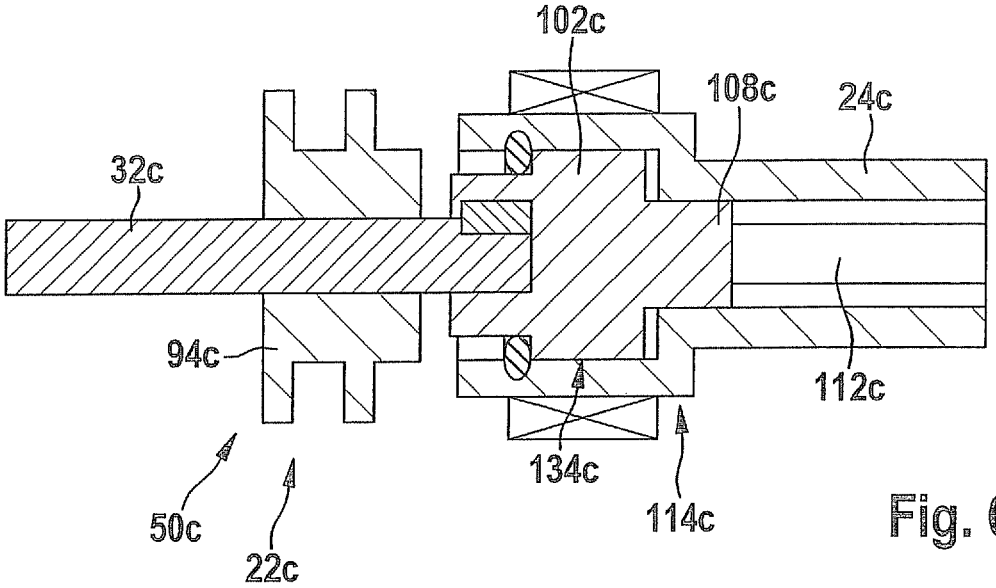
FIG. 6 shows a second alternative exemplary embodiment of a snap die of the hammer mechanism from FIG. 1 in a schematic view.
Figure 7:
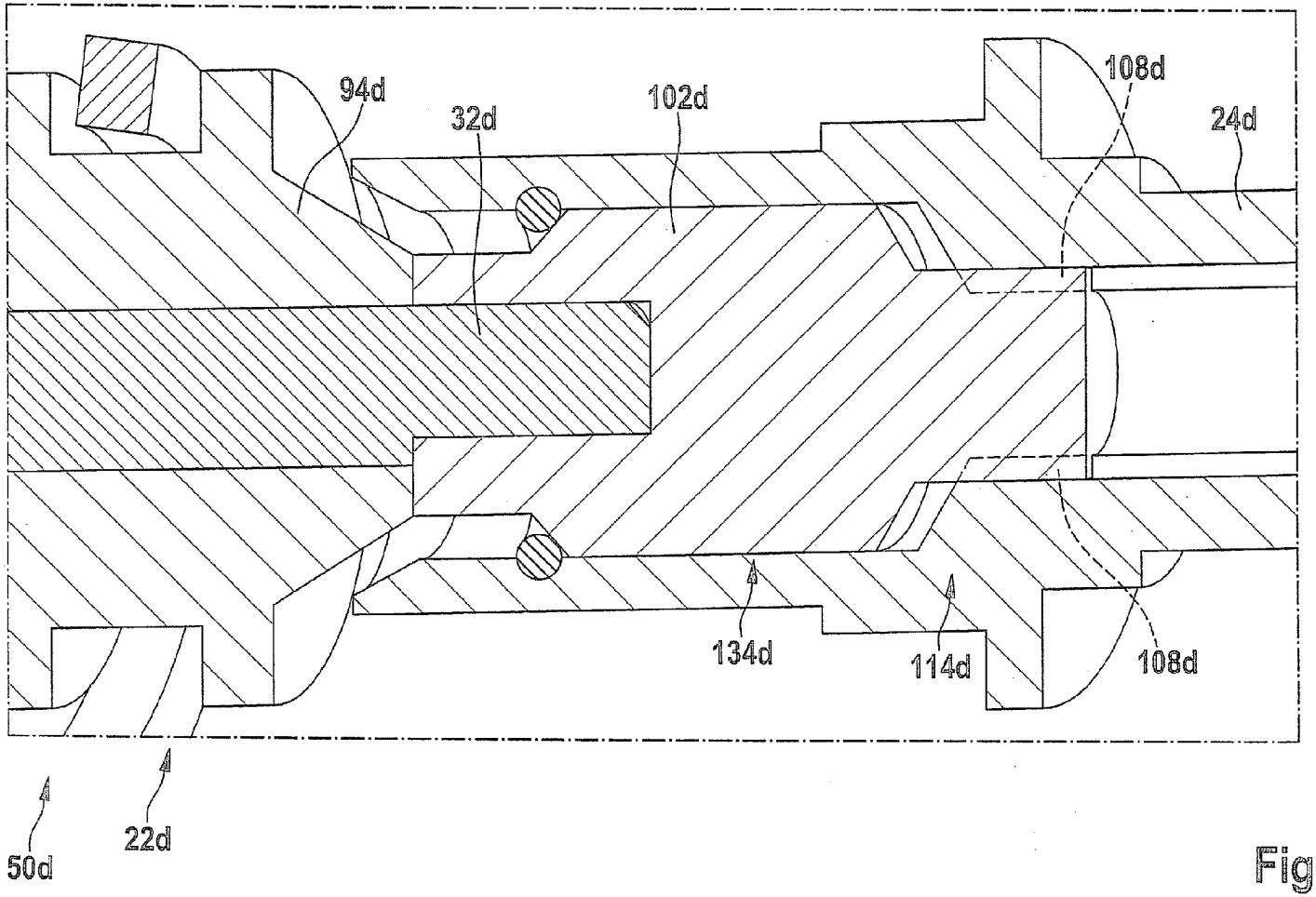
FIG. 7 shows a third alternative exemplary embodiment of a snap die of the hammer mechanism from FIG. 1 in a sectional view.
Figure 8:
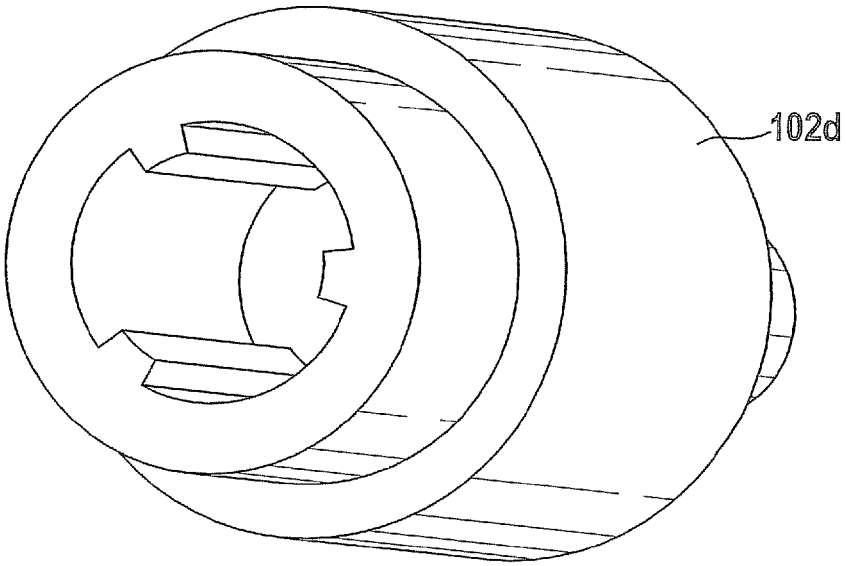
FIG. 8 shows the snap die from FIG. 7 in a first perspective view.
Figure 9:
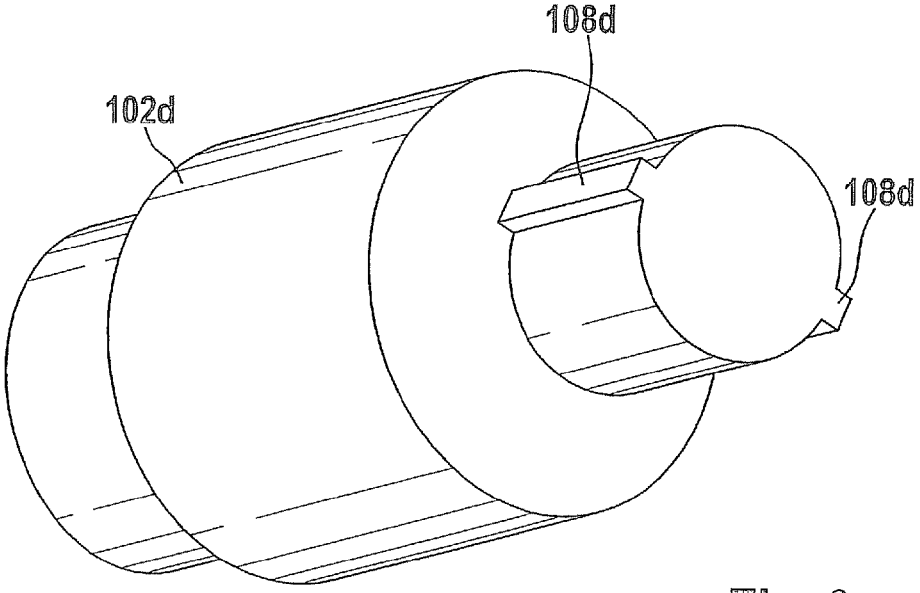
FIG. 9 shows the snap die from FIG. 7 in a second perspective view.
Figure 10:
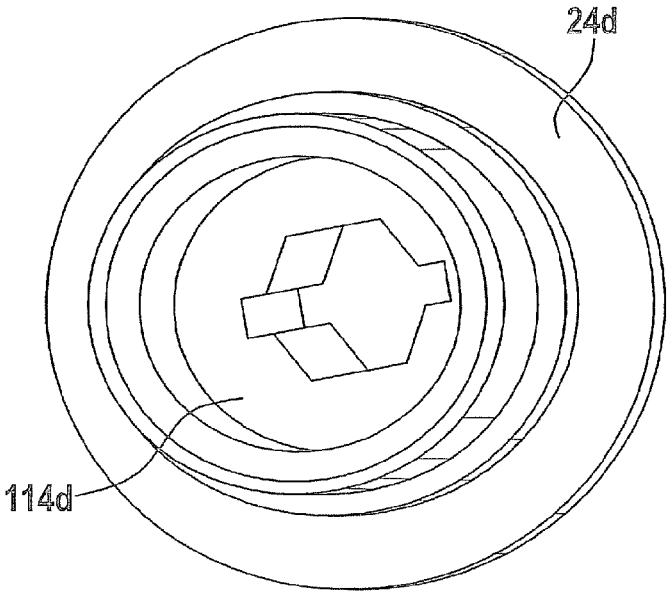
FIG. 10 shows a part of a tool chuck of the hammer mechanism from FIG. 7 in a perspective view.

Like FIG. 5, FIG. 6 schematically shows a part of a hammer mechanism 22*c*. A striker 94*c* of an impact generating unit 50*c* of hammer mechanism 22*c* is mounted so it is movable on a tool chuck drive shaft 32*c* of hammer mechanism 22*c*. Tool chuck drive shaft 32*c* is connected to a snap die 102*c* of hammer mechanism 22*c* so it is axially displaceable and rotationally fixed. Snap die 102*c* has a coupling arrangement 108*c*, which forms a rotationally fixed connection to a tool chuck 24*c* of hammer mechanism 22*c* in at least one operating state. Tool chuck 24*c* has an insertion tool coupling area 112*c*, in which coupling arrangement 108*c* of snap die 102*c* at least partially engages. Insertion tool coupling area 112*c* is provided for the purpose of causing forces to be applied in the peripheral direction on an insertion tool during operation. In an operationally ready state, coupling arrangement 108*c* is at least partially situated inside a taper 114*c* of tool chuck 24*c*. Coupling arrangement 108*c* is configured as an external hexagon. The dimensions of the external hexagon correspond to those typically had by a bit for a screwing operation. A sealing area 134*c* of snap die 102*c* presses without a gearing against tool chuck 24*c* and, in an advantageous way which may be produced cost-effectively, prevents penetration of dust into impact generating unit 50*c*. In particular, a grease loss may be minimized.

FIGS. 7 through 10 also show a part of a hammer mechanism 22*d* as a section and in perspective. A striker 94*d* of an impact generating unit 50*d* of hammer mechanism 22*d* is mounted so it is movable on a tool chuck drive shaft 32*d* of hammer mechanism 22*d*. Tool chuck drive shaft 32*d* is connected so it is axially displaceable and rotationally fixed to a snap die 102*d* of hammer mechanism 22*d*. Snap die 102*d* has a coupling arrangement 108*d*, which forms a rotationally fixed connection to a tool chuck 24*d* of hammer mechanism 22*d* in at least one operating state. In an operationally ready state, coupling arrangement 108*d* is at least partially situated inside a taper 114*d* of tool chuck 24*d*. Coupling arrangement 108*d* is configured as a gearing having two coupling ribs which are diametrically opposite with respect to a rotational axis. Coupling arrangement 108*d* has the same shape and the same dimensions as a coupling arrangement for coupling to an insertion tool. The shape and the dimensions correspond to the SDS-Quick standard. A sealing area 134*d* of snap die 102*d* presses without a gearing against tool chuck 24*d*.

Figure 11:
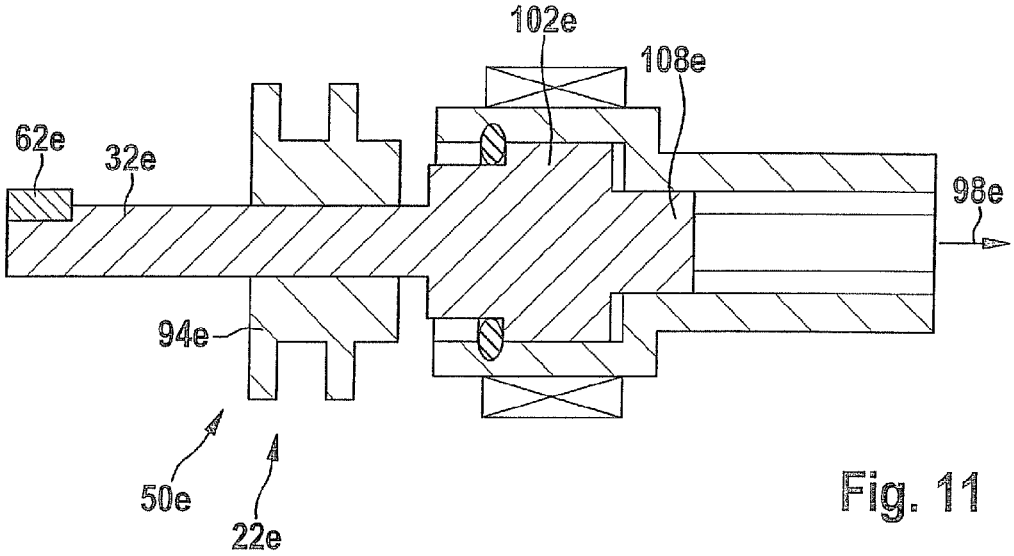
FIG. 11 shows a fourth alternative exemplary embodiment of a snap die of the hammer mechanism from FIG. 1 in a schematic view.

Like FIG. 5, FIG. 11 schematically shows a part of a hammer mechanism 22*e*. A striker 94*e* of an impact generating unit 50*e* of hammer mechanism 22*e* is mounted so it is movable on a tool chuck drive shaft 32*e* of hammer mechanism 22*e*. Tool chuck drive shaft 32*e* is connected so it is axially fixed and rotationally fixed to a snap die 102*e* of hammer mechanism 22*e*. Tool chuck drive shaft 32*e* and snap die 102*e* are formed in one piece. During an impact, striker 94*e* moves tool chuck drive shaft 32*e* and snap die 102*e* jointly in striking direction 98*e*. Tool chuck drive shaft 32*e* is connected with the aid of a coupling arrangement 62*e*, so it is axially displaceable and rotationally fixed, to a planetary gear stage described in the exemplary embodiment of FIGS. 1 through 4.

What is claimed is:

1. A hammer mechanism, comprising:

a tool chuck having an opening configured to insert and fasten an insertion tool;

an impact generating unit including:

a snap die which is axially movably mounted to the tool chuck and includes a coupling arrangement configured to transmit a rotational motion to the tool chuck;

an axially movable striker which is configured to provide an axial impact motion to the snap die, the snap die being configured to transmit the axial impact motion of the striker to the insertion tool;

a tool chuck drive shaft which is configured to transmit a rotational motion to the tool chuck via the snap die, wherein the striker is mounted in an axially movable manner on the tool chuck drive shaft and the snap die is connected to the tool chuck drive shaft in an axially movable and rotationally fixed manner; and an impact generating shutoff unit, which includes a blocking element, which is configured to prevent an axial displacement of the snap die and the tool chuck drive shaft, wherein the blocking element acts on the snap die in parallel to at least one force of the tool chuck drive shaft, which force is parallel to a rotational axis of the tool chuck drive shaft, at least during a drilling operation and which is configured to allow an axial displacement of the snap die and the tool chuck drive shaft at least during an impact operation, wherein the impact generating shutoff unit includes a sliding guide, wherein the sliding guide includes a bevel which is configured for axially moving the blocking element, wherein the blocking element is disposed at least partially forward of the striker and is mounted in a rotationally fixed manner relative to a housing element during the drilling operation and the impact operation.

2. The hammer mechanism of claim 1, wherein the tool chuck drive shaft at least partially penetrates the striker.

3. The hammer mechanism of claim 1, further comprising:

a bearing, which is configured for mounting the tool chuck drive shaft so that it is axially displaceable.

4. The hammer mechanism of claim 1, further comprising:

a planetary gear, which drives the tool chuck drive shaft in at least one operating state.

5. The hammer mechanism of claim 1, further comprising:

a coupling arrangement, which is connected in a rotationally fixed manner to the tool chuck drive shaft and is configured for driving the impact generating unit.

6. The hammer mechanism of claim 1, further comprising:

a spur gear stage, which converts a rotational speed of the tool chuck drive shaft into a higher rotational speed for impact generation.

7. A handheld tool, comprising:

a hammer mechanism, including:

a tool chuck having an opening configured to insert and fasten an insertion tool;

an impact generating unit including:

a snap die which is axially movably mounted to the tool chuck and includes a coupling arrangement configured to transmit a rotational motion to the tool chuck;

an axially movable striker which is configured to provide an axial impact motion to the snap die, the snap die being configured to transmit the axial impact motion of the striker to the insertion tool;

a tool chuck drive shaft which is configured to transmit a rotational motion to the tool chuck via the snap die, wherein the striker is mounted in an axially movable manner on the tool chuck drive shaft and the snap die is connected to the tool chuck drive shaft in an axially movable and rotationally fixed manner; and an impact generating shutoff unit, which includes a blocking element, which is configured to prevent an axial displacement of the snap die and the tool chuck drive shaft, wherein the blocking element acts on the snap die in parallel to at least one force of the tool chuck drive shaft, at least during a drilling operation and which is configured to allow an axial displacement of the snap die and the tool chuck drive shaft at least during an impact operation, wherein the impact generating shutoff unit includes a sliding guide, wherein the sliding guide includes a bevel which is configured for axially moving the blocking element, wherein the blocking element is disposed at least partially forward of the striker and is mounted in a rotationally fixed manner relative to a housing element during the drilling operation and the impact operation.

* * * * *